US010125544B2

(12) United States Patent
Urquhart

(10) Patent No.: US 10,125,544 B2
(45) Date of Patent: Nov. 13, 2018

(54) DEVICE AND METHOD FOR SUPPORTING A BECKET OF A TRAVELLING BLOCK WHEN OPENED TO CONNECT OR DISCONNECT AN ITEM

(71) Applicant: Jesse Urquhart, Edmonton (CA)

(72) Inventor: Jesse Urquhart, Edmonton (CA)

( * ) Notice: Subject to any disclaimer, the term of this patent is extended or adjusted under 35 U.S.C. 154(b) by 390 days.

(21) Appl. No.: 15/016,869

(22) Filed: Feb. 5, 2016

(65) Prior Publication Data

US 2017/0226804 A1 Aug. 10, 2017

(51) Int. Cl.
*E21B 3/00* (2006.01)
*E21B 3/02* (2006.01)

(52) U.S. Cl.
CPC ..... *E21B 3/02* (2013.01)

(58) Field of Classification Search
CPC ..... E21B 3/02
See application file for complete search history.

(56) References Cited

U.S. PATENT DOCUMENTS 4,061,388 A * 12/1977 Wilkinson ..... B66C 1/36 24/600.1
4,614,332 A * 9/1986 Wilson ..... B66D 3/046 254/405
4,676,484 A * 6/1987 Reed ..... B66D 3/06 254/402
6,481,695 B1 * 11/2002 Fuller ..... B66D 3/046 254/405
2005/0269072 A1 * 12/2005 Folk ..... E21B 19/08 166/90.1
2010/0127149 A1 * 5/2010 Kaybidge ..... B66C 1/10 248/637
2013/0112430 A1 * 5/2013 O'Blenes ..... E21B 19/008 166/380
2015/0217974 A1 * 8/2015 Richardson ..... E21B 3/02 294/215

* cited by examiner

*Primary Examiner* — Emmanuel M Marcelo
(74) *Attorney, Agent, or Firm* — Kyle R Satterthwaite; Ryan W Dupuis; Ade & Company Inc.

(57) ABSTRACT

A device for supporting a becket of a travelling block features a bar whose longitudinal dimension exceeds a distance between a first pair of support legs by which one end of the becket is pivotally supported on the travelling block. The bar is abutted against the first support legs from a side thereof facing a second pair of support legs, to which the second end of the becket is coupled when the becket is closed. A sling is connected to the bar via a connection lies intermediately of the bar's ends so as to reside between the first support legs. The sling is wrapped under the becket to an opposing side of the second pair of support legs, where a lifting cable is connected to the sling. Under tension from the lifting cable, the sling snugly cradles an underside of the becket to support same during opening of the becket.

20 Claims, 4 Drawing Sheets

L
W
T
A
A

DEVICE AND METHOD FOR SUPPORTING A BECKET OF A TRAVELLING BLOCK WHEN OPENED TO CONNECT OR DISCONNECT AN ITEM

FIELD OF THE INVENTION

The present invention relates generally to safety equipment, and more specifically to a device for temporarily supporting a becket of a travelling block when the becket is opened in order to connect or disconnect another piece of equipment to the travel block.

BACKGROUND

In a drilling rig, it is known to suspend a top drive from a travelling block by using a becket carried at the lower end of the travelling block to support the top drive via a second becket carried at the upper end of the top drive.

FIGS. 1 and 2 show a conventional travelling block 10 in which a plurality of pulley sheaves 12 are mounted on a horizontal shaft 14 supported between two side walls 16 of a housing 18. Below the housing 18 of the travelling block 10, a becket supporting framework 19 features two support plates 20, 22 of matching shape that depend downwardly away from the housing 18 in spaced apart vertical planes, each lying parallel to the shaft 14 and perpendicular to the side walls 16 of the housing. A lower end of each plate 20, 22 has an inverted U-shape, with an empty slot 24 running vertically upward between two legs. The two plates 20, 22 align with one another, whereby their aligned slots 24 define boundaries of an opening 25 passing horizontally through the becket supporting framework 19 between them in a direction perpendicular to the pulley shaft 14.

A u-shaped or arcuate becket 26 has a first end 26*a* pinned in place between a first leg 20*a* of the first support plate 20 and the matching first leg 22*a* of the other support plate 22. In the context of drilling rigs in the oil and gas industry, the becket is sometimes also referred to as a hook or clevis. In the closed position of the becket 26, shown in FIGS. 1 and 2, its second end 26*b* is likewise pinned in place between the second leg 20*b* of the first support plate 20 and the matching second leg 22*b* of the second support plate 22. With both ends 26*a*, 26*b* of the becket 26 pinned to the legs of the support plates 20, 22 by respective pins 28, 30, the becket 26 is in a closed position, in which the upward facing saddle 26*c* of the becket 26 closes off the bottom end of the opening 25 in a space 32 between the support plates 20, 22. To open the becket 26, one of the pins 30 is removed, thereby allowing the released end of the becket to swing downwardly about the axis of the other pin 28 under gravitational action, thereby opening up the lower end of the opening 25.

With the travelling block becket 26 in the open position, the peak of a top drive becket at the upper end of a top drive (not shown) can be lifted up into the opening 25, at which point the travelling block becket 26 is re-closed under the peak of the top drive becket. At this point, the peak of the top drive becket hooks over the saddle 26*c* of the travelling block becket, thereby hanging the top drive from the travelling block 10. To disconnect the top drive, the travelling block becket 26 is re-opened to enable withdrawal of the top drive becket from the travelling block becket and open space of the travelling block becket support plates.

For the safety of personnel during such opening of the travelling block becket 26 to connect or disconnect a top drive or other piece of equipment, the end 26*b* of the travelling block becket 26 being opened must be temporarily supported while being unpinned, and carefully lowered into the open position. Prior solutions for such support include the use of a sling with looped ends. One looped end of the sling is placed inside the opening 25, and a pinch bar is passed through the eye of this first looped end of the sling and inserted into an opening in the support framework 19 near the first pin 28. The sling is fed through the space 32 between the support legs 20*a*, 22*a* that carry the first end 26*a* of the travelling block becket on the first pin 28, and then is passed along the convexly curved underside 26*d* of the travelling block becket 26 to the opposing side of the travelling block, where the second end of the sling is pulled up past the second end 26*b* of the becket. Here, a lift cable from a hoist or air tugger is connected to the second looped end of the sling. The hoist or air tugger is used to pull upwardly on the second end of the sling, thus pulling the sling snugly up against the underside 26*d* of the becket 26. The sling thus cradles the becket 26 in place during the removal of the pin 30 from the second end 26*b* of the becket 26. Unpinned, this end can 26*b* then be lowered in a controlled manner by gradually letting out more of the lift cable so that the becket is carefully lowered in the open position in the controlled embrace of the sling.

However, there is a desire for improved safety in this operation, as the pinch bar can fall out of the looped end of the sling, in which case the becket quickly falls open in an unconstrained manner, and the pinch bar creates an overhead falling hazard to personnel below.

Applicant has developed an improved device for sling-based temporary support of the travelling becket, which may be used not only for drilling rigs, but for other applications in which a travelling block is employed.

SUMMARY OF THE INVENTION

According to a first aspect of the invention, there is provided a device for supporting a travelling block becket during opening of the travelling block becket, opposing first and second ends of which are respectively coupled in place between first and second pairs of support legs that depend downward from the travelling block when the becket is in a closed position for suspending an item below the travelling block, the device comprising:

a bar having first and second ends spaced apart from one another in a longitudinal direction of said bar;

a connection feature on the bar at a position lying intermediately of the first and second end of the bar;

a sling having one end thereof connected to the bar via the connection feature, whereby placement of the bar against the pair of first pair support legs at a side of said first pair of support legs that faces toward the second pair of support legs places with the connection feature located between the first pair of support legs in the longitudinal direction enables passage of the sling over the first end of the becket and into a position wrapped under the becket to the second end thereof for connection of a lifting cable to a second end of the sling such that tension exerted on the sling by the lifting cable snugly cradles an underside of the becket with the sling in order to support the becket during decoupling of the second end of the becket from the second pair of support legs and opening of the becket.

According to a second aspect of the invention, there is provided, in combination, a travelling block with a travelling block becket whose opposing first and second ends are respectively coupled in place between first and second pairs of support legs that depend downward from the travelling block when the becket is closed, and a device for supporting the becket during opening thereof, the device comprising:

a bar having first and second ends spaced apart from one another along a longitudinal direction in which said bar has a longitudinal dimension that exceeds a distance between the first pair of support legs, the bar being abutted against the first pair of support legs from a side thereof facing the second pair of support legs;

a connection feature on the bar at a position lying intermediately of the first and second ends of the bar and between the first pair of support legs in the longitudinal direction of said bar;

a sling having one end thereof coupled to the bar via the connection feature, the sling passing between the first pair of support legs past the first end of the becket, from which the sling is wrapped under the becket to a side of the second pair of support legs facing away from the first pair of support legs, where a lifting cable is connected to a second end of the sling such that tension exerted on the sling by the lifting cable snugly cradles an underside of the becket with the sling in order to support the becket during decoupling of the second end of the becket from the second pair of support legs and opening of the becket.

Preferably there is provided at least one stop jutting outwardly from said bar in a lateral direction transverse to said longitudinal dimension at a position adjacent a respective one of the first and second ends of the bar for placement outside a respective one of the first pair of support legs to limit or prevent motion of the bar across a space defined between said first pair of support legs.

Preferably the at least one stop comprises first and second stops respectively adjacent the first and second ends of the bar for placement outside the first pair of support legs to limit or prevent motion of the bar across the space defined between said first pair of support legs.

Preferably the connection feature juts outwardly from the bar in the same lateral direction as each stop.

Preferably the sling comprises a closed connection loop via which the sling is coupled to the connection feature of the bar.

Preferably the sling comprises a closed pulling loop by which the sling is connectable to the lifting cable.

The connection feature may comprise a connection lug jutting outwardly from the bar and having a through-hole therein through which a connection between the sling and the bar is enabled.

In such embodiments, the device preferably comprises a shackle that couples the sling to the connection lug of the bar.

Alternatively, the connection feature may comprise a snap hook projecting from the bar and having an upward-opening mouth and a closure gate biased into a normally closed position across said upward-opening mouth of the snap hook.

Preferably magnetic material is carried on the bar to magnetically attract the bar to the first pair of support legs.

Preferably the magnetic material comprises one or more permanent magnets attached to the bar.

Preferably the magnetic material is at least partially recessed within the bar.

Preferably a face of the magnetic material is flush with or slightly recessed from a face of the bar.

Preferably the magnetic material is recessed into the bar from a face thereof that faces the same lateral direction in which each stop extends.

According to a third aspect of the invention there is provided a method of supporting a becket of a travelling block during opening of the becket, the method comprising:

(a) using a bar that has first and second ends spaced apart from one another in a longitudinal direction of said bar and a connection feature on the bar at a position lying intermediately of the first and second ends of the bar, placing said bar in a working position against a first pair of support legs between which one end of the becket is coupled so that the bar abuts said first pair of support legs at a side thereof facing a second set of support legs between which a second end of the becket is coupled;

(b) before or after step (a), and via a space between the first pair of support legs, connecting a sling between the connection feature of the bar and a lifting cable that is situated on a side of the second pair of support legs facing away from the first pair of support legs such that the sling wraps beneath the becket to the lifting cable; and (c) after steps (a) and (b), applying tension to the sling through the lifting cable in order to force the sling snugly against an underside of the becket in order to support same while opening the becket by decoupling the second end therefrom from the second pair of support legs.

Preferably step (a) comprises magnetically securing the bar to the first pair of support legs to magnetically retain the bar in the working position.

According to a fourth aspect of the invention, there is provided a device for supporting a travelling block becket during opening of the travelling block becket, opposing first and second ends of which are respectively coupled in place between first and second pairs of support legs that depend downward from the travelling block when the becket is in a closed position for suspending an item below the travelling block, the device comprising:

a bar having first and second ends spaced apart from one another in a longitudinal direction of said bar;

first and second stops jutting outwardly from said bar in a lateral direction transverse to said longitudinal direction at positions that reside respectively adjacent the first and second ends of said bar, a sling having a first end thereof connected to the bar at a position lying intermediately of the first and second stops in the longitudinal direction;

whereby placement of the bar against the pair of first pair support legs at a side of said first pair of support legs that faces toward the second pair of support legs places, with the stops residing outside the first pair of support legs to limit or prevent motion of the bar across a space defined between said first pair of support legs, places the first end of the sling between the first pair of support legs and enables passage of the sling over the first end of the becket and into a position wrapped under the becket to the second end thereof for connection of a lifting cable to a second end of the sling such that tension exerted on the sling by the lifting cable snugly cradles an underside of the becket with the sling in order to support the becket during decoupling of the second end of the becket from the second pair of support legs and opening of the becket.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 2:
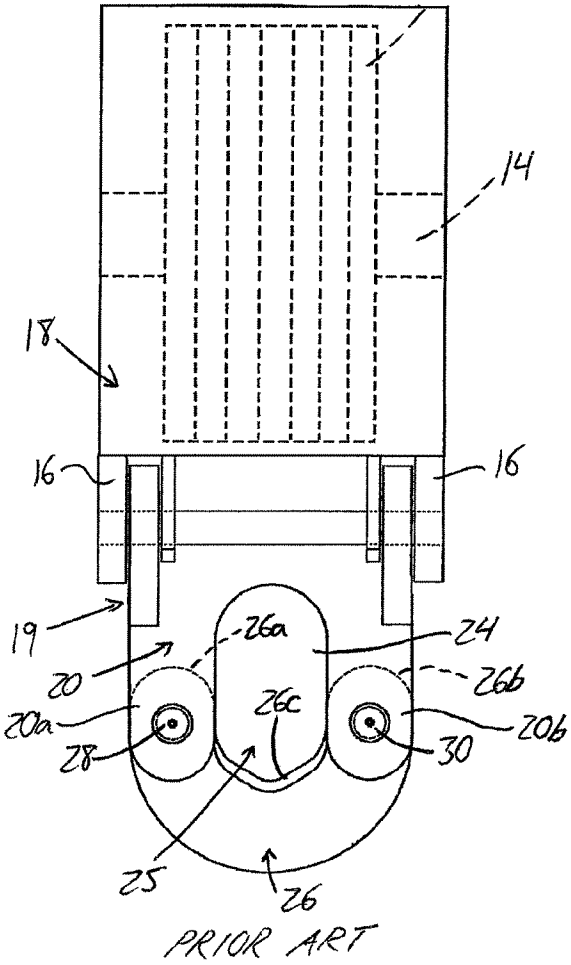
FIG. 2 is a front view of the prior art travelling block and becket of FIG. 1.
Figure 1:
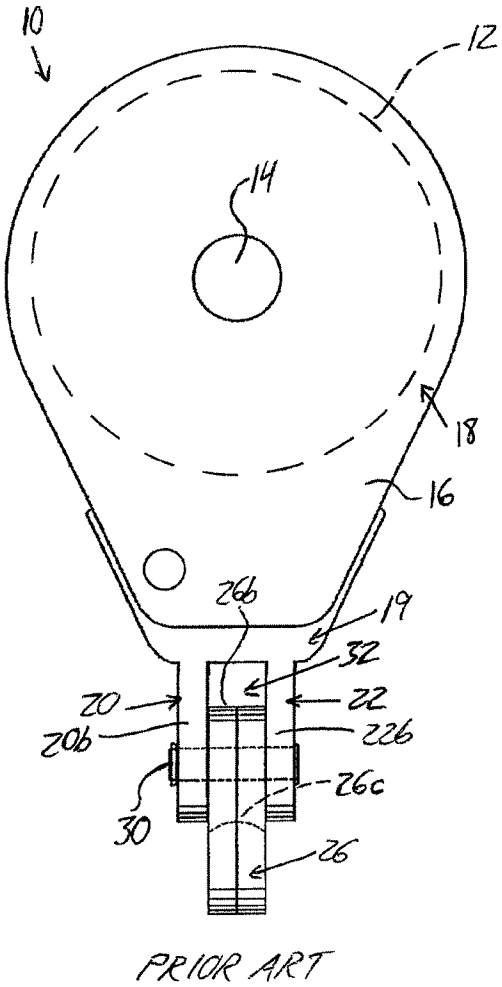
FIG. 1 is a side view of a prior art travelling block and becket.

FIGS. 3 to 6 illustrate installation of a device 100 of the present invention for temporarily supporting the becket of a conventional travelling block 10 of the type described in the background section herein above. The device 100 once again employs a sling 102 for such purposes, but replaces the use of a standard pinch bar with a novel shackle-equipped bar member 104 that is configured to mate with the becket support framework 19 in a manner confidently securing it in place to avoid the overhead falling hazard presented by use of a standard pinch bar.

Figures 5, 6, 7, 8:
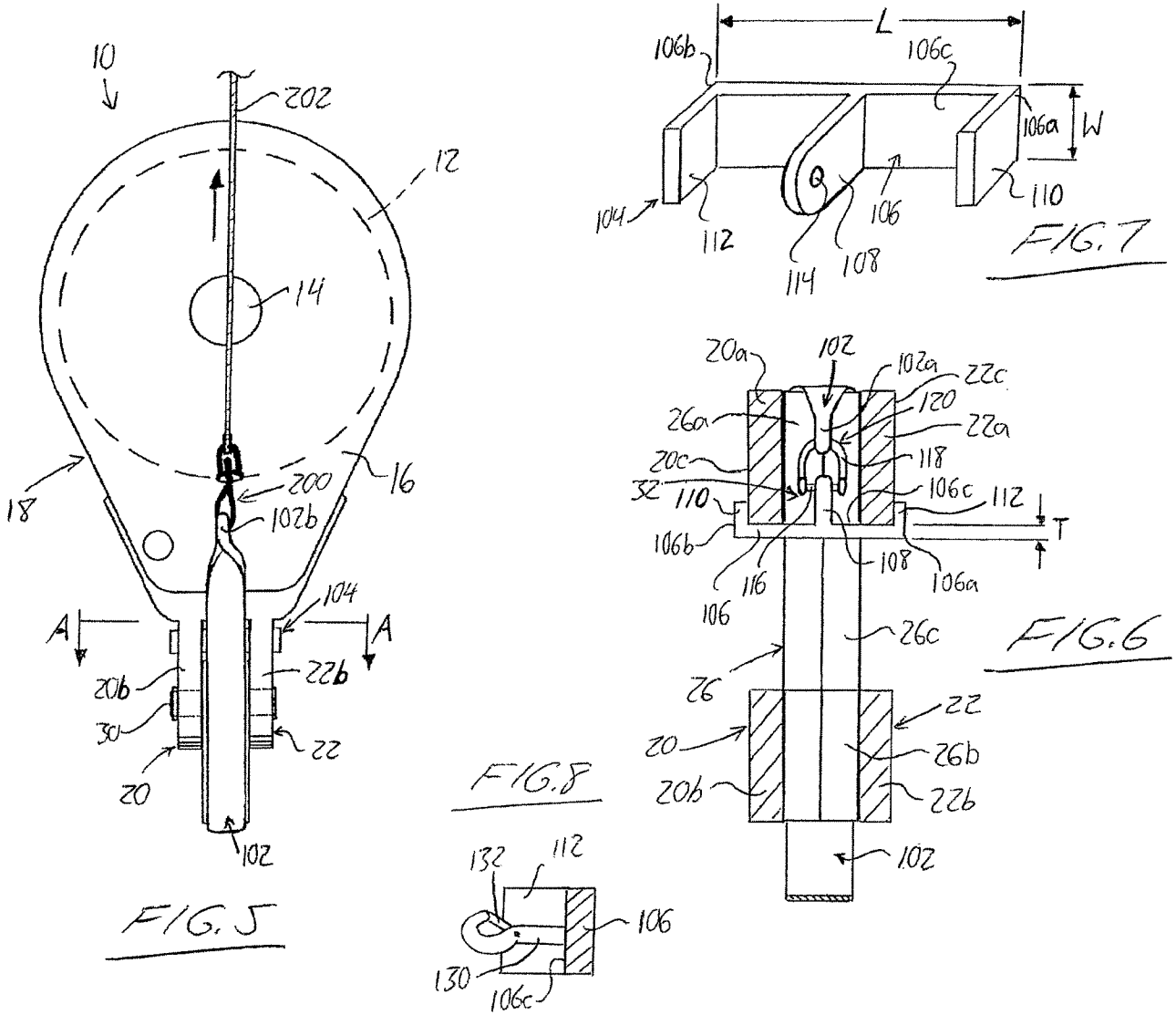
FIG. 5 is a side view of the support device, travelling block and becket of FIG. 3 from an opposing side thereof.
FIG. 6 is a cross-sectional view of the support device, travelling block and becket of FIG. 5 as taken along line A-A thereof.
FIG. 7 is a perspective view of the support device of FIGS. 3 to 6, with a sling and shackle thereof omitted for ease of illustration.
FIG. 8 is a partial cross-sectional view of a bar member of a second embodiment of the device, in which a quick release hook is used to connect the sling to the bar member.

Turning to FIG. 7, the bar member 104 features a main bar 106 having the shape of a rectangular cuboid with a longitudinal dimension L, a smaller width dimension W, and an even smaller thickness dimension T. At an intermediate location disposed centrally between the ends 106*a*, 106*b* of the main bar 106 in the longitudinal dimension L, a connection lug 108 projects from a face 106*c* of the main bar in a plane perpendicular to the plane of this face 106*c* so as to extend in a transverse direction perpendicular to the longitudinal dimension L. At each end 106*a*, 106*b* of the main bar 106, a respective stop tab 110, 112 projects from the same major face 106*c* of the main bar 106 in a plane parallel to that of the connection lug 108 so as to extend in the same transverse direction with an empty space left between the stop tab 110, 112 and the central connection lug 108. Near a distal end of the lug connection lug 108 furthest from the main bar 106, a through-hole 114 passes through the connection lug 108 on an axis parallel to the longitudinal dimension L. With the lug 108 and stop tabs 110, 112 all projecting in the same direction from the main bar 106 on the same side thereof, the bar member 104 is generally E-shaped. As shown in the illustrated embodiment, the lug 108 may be longer than the stop tabs 110, 112 and thus project further from the main bar 106, though this is not necessary of all embodiments.

With reference to FIG. 6, a pin 116 is passed through the hole 114 in the connection lug and mates with the ends of a clevis 118 on opposing sides of the connection lug 108, thereby forming a shackle 120 that is secured to the bar member 104 via the hole 114 in the connection lug 108.

The sling 102 is formed of a length of flexible flat strip webbing of significantly greater length than width, and having each of its two ends 102*a*, 102*b* folded back over itself for a short distance, where the folded end of the sling is then sewn back onto itself to form a closed loop 102. As illustrated by a reduced width of the sling at each such looped end 102*a*, 102*b*, the webbing may also folded over and sewn to itself in the width dimension of the sling at each looped end thereof, thus increasing the thickness of the sling at these looped ends for added strength. During assembly of the device 100, the clevis 118 of the shackle 120 is passed through a first one of the looped ends 102*a* of the sling 102 before the pin 116 is engaged to the clevis ends through the connection lug 108 of the bar unit 104, thereby securing the sling 102 to the bar member 104. The looped first end 102*a* of the sling thus forms a closed connection loop by which it is coupled to the bar member.

The distance between the two stop tabs 110, 112 of the bar member 106 in the longitudinal dimension L slightly exceeds the distance between the outer faces 20*c*, 22*c* of the first pair of support legs 20*a*, 22*a* between which the first end 26*a* of the becket 26 is coupled by the hinge pin 28 on which the becket 26 will swivel when opened. The distance between each stop tab 110, 112 and the connection lug 108 in the longitudinal dimension L exceeds the thickness of each support plate 20, 22 at the first legs 20*a*, 20*b* thereof.

Figure 4:
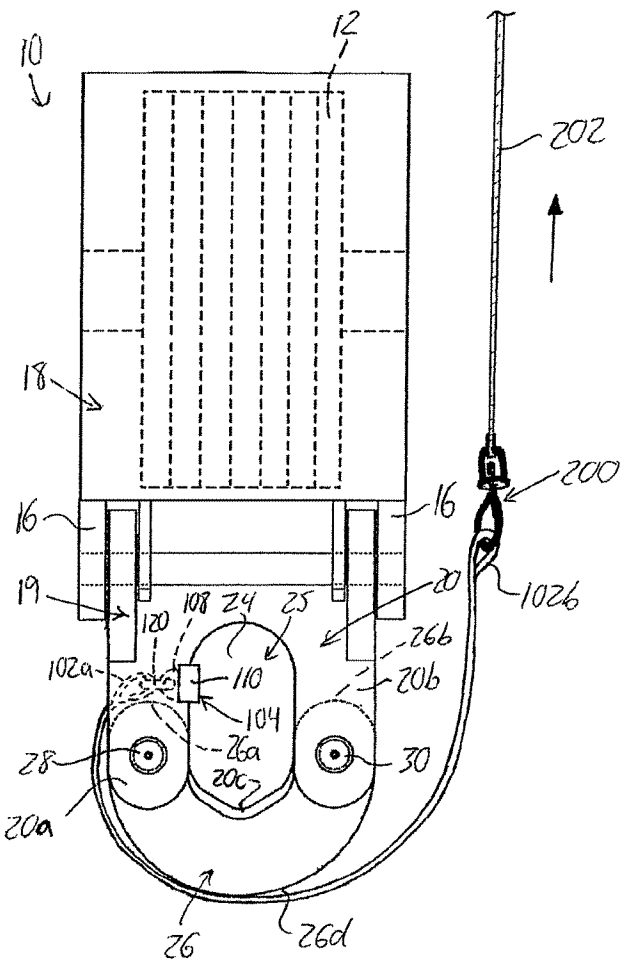
FIG. 4 is a front view of the support device, travelling block and becket of FIG. 3.
Figure 3:
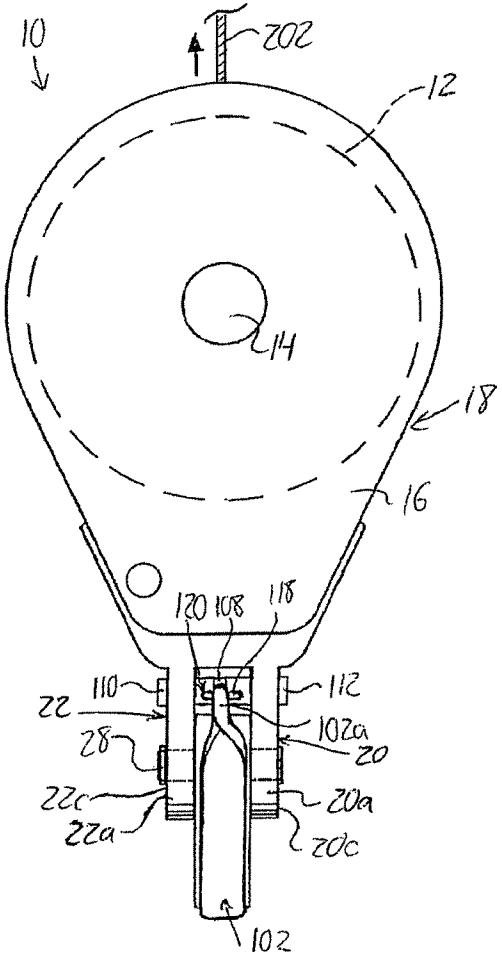
FIG. 3 is a side view illustrating installation of a support device according to a first embodiment of the present invention to temporarily support the becket on the travelling block of FIG. 1 during opening of same in order to connect or disconnect a top drive to or from the travelling block.

To install the device 100 on the travelling block 10, the face 106*c* of the main bar portion 106 of the bar member 104 is placed against the first pair of support legs 20*a*, 22*a* at the sides thereof that face toward the second pair of support legs 20*b*, 22*b* in a position placing the two stop tabs 110, 112 outside the first pair of support legs 20*a*, 22*a* adjacent the outer faces 20*c*, 22*c* thereof such that the connection lug 108 is received in the space 32 between the first pair of support legs 20*a*, 22*a*, as best shown in FIGS. 4 and 6. With the sling 102 thus connecting to the bar member 104 via the shackle 120 at a position overtop the first end 26*a* of the becket within the space 32 between the first pair of support legs 20*a*, 22*a*, the sling is pulled out from this space 32 through the open side thereof lying opposite to the bar member 104. Here, at this side of the first pair of support legs 20*a*, 22*a* facing away from the second pair of support legs 20*b*, 22*b*, the sling 102 is drawn downwardly from the first end 26*a* of the becket 26 and then across the underside 26*d* of the becket to the side of the second pair of support legs 20*b*, 22*b* facing away from the first pair of support legs 20*a*, 22*a*. Here, the second looped end 102*b* of the support sling is then pulled upwardly past the second end 26*b* of the becket 26.

At this point, a swivel coupler 200 attached to the free end of a lifting cable 202 of a winch or tugger (not shown) that is mounted further up the derrick of the drilling rig is coupled to the second looped end 102*b* of the sling 102. The second looped end thus forms a closed pulling loop by which the sling can be pulled by the winch or tugger. Throughout this process of routing the sling 102 down and around the becket 26, tension is manually maintained on the sling 102 so as to continually pull the bar member 104 against the first pair of support legs 20*a*, 22*a* and thereby maintain the position of the bar member 104 against the sides of these support legs 20*a*, 22*a*, while the stop tabs 110, 112 limit or prevent displacement of the bar member in either direction across the space between the first support legs 20*a*, 22*a* in the longitudinal direction of the bar 104.

Once the lifting cable 202 is coupled to the second end 102*b* of the sling 102, the winch or tugger is operated in the cable-winding direction to pull the lifting cable 202 upwardly, thereby taking up the slack of the sling 102 in order to draw the same snugly up against the underside 26*d* of the becket 26, and thus taking over the need for manual tensioning of the sling to maintain the bar member's working position abutted against the first support legs 20*a*, 22*a*. With the sling 102 in this tensioned state, it cradles the underside of the becket 26, thereby supporting the same in place while the pin 30 at the second end 26*b* of the becket is removed, thereby decoupling the becket 26 from the second pair of support legs 20*b*, 22*b*. The lifting cable 202 can then be slowly let out from the drum of the winch or tugger in order to lower the second end 26*b* of the becket 26 in a controlled fashion about the pivot axis defined the hinge pin 28 at the first end of the becket 26.

With the travelling block becket 26 opened in this manner with its second end 26*b* fully lowered into its fully opened stably hanging position the lift line is disconnected from the second end of the sling to open up access to the space 25 from the second side of the travelling block at the area below the second pair support legs 20*b*, 22*b*. This way, with the travelling block having been previously lowered into a position safely seating the top drive on a suitable support to which it is preferably pinned for stability during disconnection of the top drive from the travelling block, the becket of the top drive can be removed from the opening 25 in which it previously spanned over the cradle 26*c* of the becket 26 of the travelling block 10 in a position hanging therefrom. Likewise a top drive can be installed by re-closing the travelling block becket 26 through the becket of the seated and pinned top drive, at which point the top drive will be suspended from the travelling block when the top drive is unpinned and the travelling block is raised. To continue supporting the bar member 104 in its working position when the lift line is connected, a lanyard or other support line can be connected to the bar member 104 through the space between the first support legs 20*a*, 22*a*, for example by hooking it to the clevis, and then tensioned to hold the bar member in place until such time as the top drive has been placed in or removed from the receiving space 25. At this point, the lift line is reconnected to the second end of the sling through the becket on the top drive, and then pulled to tension the sling against the becket, and pulled further to lift the second end of the becket back up into the space between the second pair of support legs for recoupling thereto by way of pin 30, thus reclosing the traveling block becket with the top drive now suspended therefrom. The lift bar is the disconnected, and the bar member removed.

While the illustrated embodiments employ stop tabs 110, 112 to limit or prevent displacement across the space 32 between the support legs 20*a*, 20*b* of the becket support framework 19 in order to prevent sliding and tilting of the bar member into a position and orientation in which it could slide through the space 32 between the support legs and create a falling hazard, other embodiments may omit such stop tabs and instead employ a longitudinal dimension L of great enough length that cannot pass through the space 32 regardless of its orientation or position at the inner side of the support legs 20*a*, 22*b* (e.g. a longitudinal dimension that exceeds both a height and a diagonal measurement of the space 32). Another embodiment may employ a single stop tab only at the outside of the one of the support legs 20*a*, 22*a*, which cooperates with the lug 108 disposed between the support legs 20*a*, 22*b* to limit sliding and tilting of the bar member. Bar members with stop tabs may be produced with different spacing between the stop tabs to account for different spacing and thicknesses of the support legs among different travelling blocks. In other embodiments, the bar member may have a telescopic structure, for example its main bar portion being formed telescopically mated pieces of hollow metal tubing than can be pinned or otherwise locked together at any of a number of different telescopic positions to adjust the longitudinal dimension of the bar between the ends thereof, thereby providing the device with adjustability for use on travelling blocks of different sizes.

The sling may be removably attachable to the bar member by means other than cooperation between a connection lug of the bar and a shackle or other coupler. For example, in another embodiment shown in FIG. 8, a snap hook 130 projects laterally outward from the main bar portion in place of the connection lug 108 of the first embodiment, with the mouth of the hook facing upward, and with a spring biased closure gate 132 normally closing off the mouth of the hook. The looped first end of the sling 102*a* can be easily engaged into the hook and removed therefrom via the spring loaded closure gate, thus providing the device with a quick release functionality that doesn't require opening and closing of a clevis. As the tensioning of the sling pulls downward on the hook, i.e. away from the openable/closeable gate, the upward-opening orientation of the hook's mouth prevents inadvertent decoupling of the sling.

Other embodiments may employ other modes of connection to the bar, including permanent attachment thereto, for example by permanent closure of the looped first end of the sling through a hole in the bar that replaces the connection lug or snap hook as the connection feature on the bar to which the sling is coupled. However, a releasable connection via a shackle, hook or other means allows use any sling with the bar, for example enabling use of slings that are separately manufactured or purchased from the bar. In one embodiment, the bar member is made of welded together steel plates, although other materials and fabrication techniques may alternatively be employed.

Figure 9:
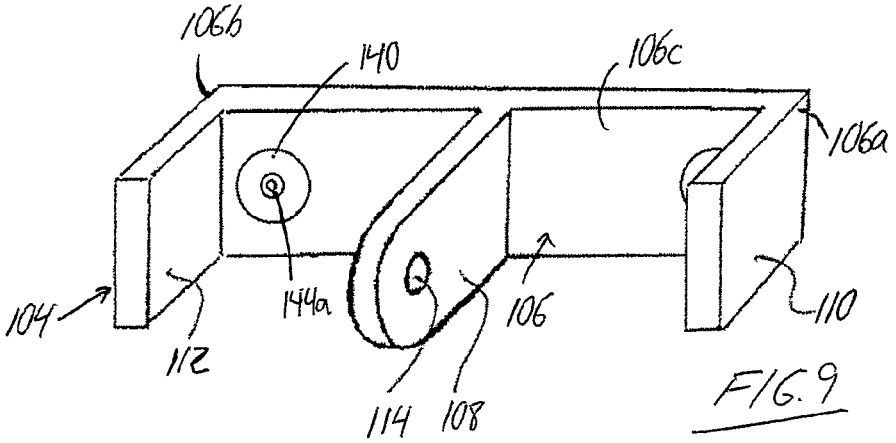
FIG. 9 is a perspective view of a third embodiment of the device, which features magnets on the bar member to more securely support the device in a working position on the travelling block.
Figure 10:
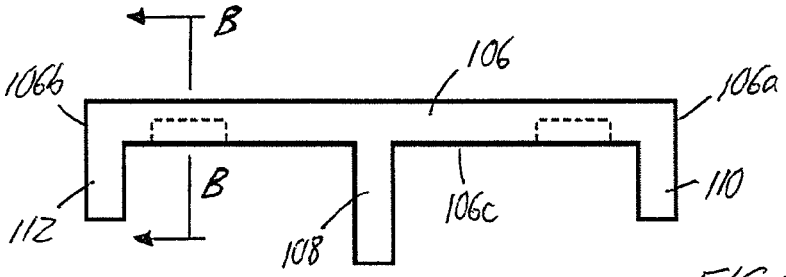
FIG. 10 is a top plan view of the device of FIG. 9.
Figure 11:
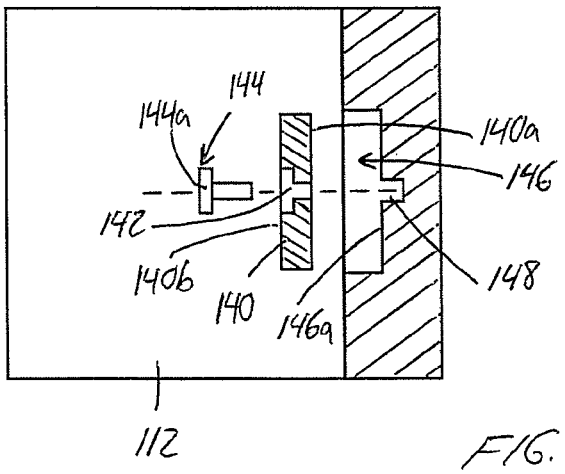
FIG. 11 is an exploded cross-sectional view of the device of FIG. 10 as viewed along line B-B thereof.

FIGS. 9 through 11 illustrate another embodiment in which the bar member 104 features a pair of permanent magnets 140 flush mounted at the major face 106*c* of the main bar 106 so as to magnetically attach the main bar 106 to the support legs 20*a*, 22*a* of the travelling block when placed thereagainst in the working position. This self-attachment of the device to the travelling block improves safety and ease of installation by automatically holding the bar member in place while routing the sling into place beneath the becket. For sufficient strength of attraction, rare earth magnets may be employed.

In the illustrated embodiment, each magnet 140 has an annular form with a cylindrical outer periphery and a central bore 142 passing axially through it to accommodate a threaded fastener 144 by which the magnet 140 is held to the bar member 104. For each magnet 140, the bar member features a respective cylindrical socket 146 recessed into the major face 106*c* of the main bar 106 at an intermediate position between the connection lug 108 and a respective one of the stop tabs 110, 112. As shown, each magnet may be positioned nearer to the respective stop tab than to the connection lug 108. The socket 146 slightly exceeds the magnet in diameter and is equal to or slightly greater than the magnet in depth (i.e. axial length), whereby seating the inner end 140*a* of the magnet 140 against the closed end 146*a* of the socket 146 places the entirety of the magnet 140 inside the socket so that the outer end 140*b* of the magnet resides flush with, or slightly recessed from, the major face 106*c* of the main bar 106. The central axial bore 142 of the magnet 140 is countersunk at the outer end 140*b* thereof so that the head 144*a* of the threaded fastener 144 is likewise flush with, or slightly recessed from, the outer end 140*b* of the magnet. The threaded shaft 144*b* of the fastener 144 passes through the central axial bore 142 from the countersunk end thereof, and mates with a threaded blind hole 148 that extends axially into the closed end of the socket at the center thereof. Each magnet is installed by engaging the respective fastener 144 into the threaded central hole 148 of the respective socket 146 via the central axial bore 142 of the magnet 140. Having each magnet 140 flush with or slightly recessed from the major face 106*c* of the main bar 106 places the magnet in the close proximity to the support arms of the travelling block, for maximum attraction thereto, without interfering with flush placement of the major face 106*c* of against the support arms. It will be appreciated that the type, number, position and mounting details of the magnets may be varied within the scope of the present invention.

While the detailed embodiments above describes opening and closing of the becket for the purpose of connecting or disconnecting a top drive, other items or equipment, for example a bridle line equalizer sheave, may be connected and disconnected in the same manner through use of the device of the present invention. In addition, the use of the device is not limited to drill rig applications, and may be used for other applications where a travelling block is used, for example on cranes used in the construction industry.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A device for supporting a travelling block becket of a travelling block during opening of the travelling block becket, opposing first and second ends of which are respectively coupled in place between first and second pairs of support legs that depend downward from the travelling block when the becket is in a closed position for suspending an item below the travelling block, the device comprising:

a bar having first and second ends spaced apart from one another in a longitudinal direction of said bar;

a connection feature on the bar at a position lying intermediately of the first and second end of the bar;

a sling having one end thereof connected to the bar via the connection feature, whereby placement of the bar against the pair of first pair support legs at a side of said first pair of support legs that faces toward the second pair of support legs places with the connection feature located between the first pair of support legs in the longitudinal direction enables passage of the sling over the first end of the becket and into a position wrapped under the becket to the second end thereof for connection of a lifting cable to a second end of the sling such that tension exerted on the sling by the lifting cable snugly cradles an underside of the becket with the sling in order to support the becket during decoupling of the second end of the becket from the second pair of support legs and opening of the becket.

2. The device of claim 1 in combination with the travelling block, the support legs, the travelling block becket and the lifting cable, wherein the bar is abutted against the first pair of support legs from a side thereof facing the second pair of support legs, the connection feature is located between the first pair of support legs, and the sling passes between the first pair of support legs past the first end of the becket, from which the sling wraps under the becket to a side of the second pair of support legs facing away from the first pair of support legs, where the lifting cable connects to the second end of the sling to exert the tension on the sling.

3. The device of claim 2 comprising at least one stop jutting outwardly from said bar in a lateral direction transverse to said longitudinal dimension at a position adjacent a respective one of the first and second ends of the bar and outside a respective one of the first pair of support legs.

4. The device of claim 2 comprising first and second stops jutting outwardly from said bar in a lateral direction transverse to said longitudinal dimension at positions that reside respectively adjacent the first and second ends of said bar, reside outside the first pair of support legs, and limit or prevent motion of the bar across a space defined between said first pair of support legs.

5. The device of claim 1 comprising at least one stop jutting outwardly from said bar in a lateral direction transverse to said longitudinal dimension at a position adjacent a respective one of the first and second ends of the bar.

6. The device of claim 5 wherein the connection feature juts outwardly from the bar in the same lateral direction as each stop.

7. The device of claim 5 comprising magnetic material carried on the bar to magnetically attract the bar to the first pair of support legs, the magnetic material being flush with, or slightly recessed from, a face of the bar that faces the same lateral direction in which each stop extends.

8. The device of claim 1 comprising first and second stops jutting outwardly from said bar in a lateral direction transverse to said longitudinal dimension at positions respectively adjacent the first and second ends of the bar.

9. The device of claim 1 wherein the sling comprises a closed connection loop via which the sling is coupled to the connection feature of the bar.

10. The device of claim 1 wherein the sling comprises a closed pulling loop by which the sling is connectable to the lifting cable.

11. The device of claim 1 wherein the connection feature comprises a connection lug jutting outwardly from the bar and having a through-hole therein through which a connection between the sling and the bar is enabled.

12. The device of claim 11 comprising a shackle that couples the sling to the connection lug of the bar.

13. The device of claim 1 wherein the connection feature comprises a snap hook projecting from the bar and having an upward-opening mouth and a closure gate biased into a normally closed position across said upward-opening mouth of the snap hook.

14. The device of claim 1 comprising magnetic material carried on the bar to magnetically attract the bar to the first pair of support legs.

15. The device of claim 14 wherein the magnetic material comprises one or more permanent magnets attached to the bar.

16. The device of claim 14 wherein a face of the magnetic material resides flush with, or slightly recessed from, with a face of the bar.

17. A method of supporting a becket of a travelling block during opening of the becket, the method comprising:

(a) using a bar that has first and second ends spaced apart from one another in a longitudinal direction of said bar and a connection feature at a position lying intermediately of the first and second ends of the bar, placing said bar in a working position against a first pair of support legs between which one end of the becket is coupled so that the bar abuts said first pair of support legs at a side thereof facing a second set of support legs between which a second end of the becket is coupled;

(b) before or after step (a), and via a space between the first pair of support legs, connecting a sling between the connection feature of the bar and a lifting cable that is situated on a side of the second pair of support legs facing away from the first pair of support legs such that the sling wraps beneath the becket to the lifting cable; and (c) after steps (a) and (b), applying tension to the sling through the lifting cable in order to force the sling snugly against an underside of the becket in order to support same while opening the becket by decoupling the second end therefrom from the second pair of support legs.

18. The method of claim 17 wherein the bar comprises first and second stops jutting outwardly from said bar in a lateral direction transverse to said longitudinal dimension at positions residing respectively adjacent the first and second ends of said bar outside the first pair of support legs, and step (a) comprises positioning the stops outside the first pair of support legs in positions limiting or preventing motion of the bar across a space defined between said first pair of support legs.

19. The method of claim 17 wherein step (a) comprises magnetically securing the bar to the first pair of support legs to magnetically retain the bar in the working position.

20. A device for supporting a travelling block becket during opening of the travelling block becket, opposing first and second ends of which are respectively coupled in place between first and second pairs of support legs that depend downward from the travelling block when the becket is in a closed position for suspending an item below the travelling block, the device comprising:

a bar having first and second ends spaced apart from one another in a longitudinal direction of said bar;

first and second stops jutting outwardly from said bar in a lateral direction transverse to said longitudinal direction at positions that reside respectively adjacent the first and second ends of said bar, a sling having a first end thereof connected to the bar at a position lying intermediately of the first and second stops in the longitudinal direction;

whereby placement of the bar against the pair of first pair support legs at a side of said first pair of support legs that faces toward the second pair of support legs places, with the stops residing outside the first pair of support legs to limit or prevent motion of the bar across a space defined between said first pair of support legs, places the first end of the sling between the first pair of support legs and enables passage of the sling over the first end of the becket and into a position wrapped under the becket to the second end thereof for connection of a lifting cable to a second end of the sling such that tension exerted on the sling by the lifting cable snugly cradles an underside of the becket with the sling in order to support the becket during decoupling of the second end of the becket from the second pair of support legs and opening of the becket.

* * * * *